United States Patent [19]

Wingert

[11] Patent Number: 4,776,490

[45] Date of Patent: Oct. 11, 1988

[54] GLUE GUN WITH ADVANCING MECHANISM FOR GLUE STICK

[75] Inventor: Rudolf Wingert, West Milford, N.J.

[73] Assignee: Electro-Matic Staplers, Inc., Saddle Brook, N.J.

[21] Appl. No.: 917,196

[22] Filed: Oct. 9, 1986

[51] Int. Cl.[4] ..... B05C 5/04

[52] U.S. Cl. ..... 222/146.5; 74/128; 74/470; 226/127

[58] Field of Search ..... 74/128, 141.5, 470; 226/154, 156, 167, 129, 127; 228/52, 53; 222/146.1, 146.2, 146.5

[56] References Cited

U.S. PATENT DOCUMENTS

| | | | |
|---|---|---|---|
| 2,396,799 | 3/1946 | McCully | 228/53 |
| 2,647,412 | 8/1953 | Warmoes et al. . | |
| 3,377,012 | 4/1968 | Cushman . | |
| 3,612,357 | 10/1971 | Ruskin . | |
| 3,743,142 | 7/1973 | Elliot et al. | 222/146.5 |
| 3,744,921 | 6/1973 | Weller et al. . | |
| 4,053,087 | 10/1977 | Lack et al. . | |
| 4,167,245 | 9/1979 | Kock et al. . | |
| 4,289,257 | 9/1981 | Herb et al. . | |
| 4,378,076 | 3/1983 | Stirnweiss . | |
| 4,523,705 | 6/1985 | Belanger et al. | 222/146.5 |
| 4,621,748 | 11/1986 | Dziki | 222/146.5 |
| 4,637,745 | 1/1987 | Speisebecher et al. | 222/146.5 |
| 4,660,743 | 4/1987 | Speisebecher et al. | 222/146.5 |

FOREIGN PATENT DOCUMENTS

| | | | |
|---|---|---|---|
| 3100830A1 | 8/1982 | Fed. Rep. of Germany | 222/146.2 |
| 670973 | 4/1952 | United Kingdom . | |

*Primary Examiner*—H. Grant Skaggs

*Attorney, Agent, or Firm*—Pasquale A. Razzano

[57] ABSTRACT

A glue gun having an advancing mechanism which has a longitudinally slidable carriage member with a longitudinal opening for the glue stick is provided. The carriage member has a first transverse opening in communication with the longitudinal opening and a second transverse opening in communication with the first transverse opening which is also transvers to the first transverse opening. The first transverse opening has internal peripheral bearing surfaces. A substantially T-shaped angularly displaceable gripper member is included which has an upper member defining a gripper head and a lower member defining a transverse lever. The gripper head is receivable into the first transverse opening and has a front end, a rear end, an upper end and a gripper tooth near its front and upper ends for gripping the glue stick. The gripper head further has exterior peripheral bearing surfaces near its front and rear ends which slidably bear against the internal peripheral bearing surfaces of the first transverse opening to retain the gripper head in the first transverse opening while permitting angular displacement of the head.

8 Claims, 3 Drawing Sheets

GLUE GUN WITH ADVANCING MECHANISM FOR GLUE STICK

FIELD OF THE INVENTION

This invention relates generally to devices for heating and melting a piece of rod-shaped thermoplastic material and discharging the melted material for use as an adhesive. In particular, the present invention relates to a manually operated device, commonly referred to as a "glue gun", having a novel mechanism for advancing the rod-shaped thermoplastic material.

BACKGROUND OF THE INVENTION

Glue guns for manual operation typically include a tube shaped heating chamber and frequently a seal for the entering glue stick at its rear end and a nozzle on its front end for discharging the melted material. A housing is generally included which has a hand grip for the convenience of the user. As the solidified glue stick is advanced into the heating chamber, the portion of the glue stick which is in the heating chamber is heated to beyond its melting point, and the remainder of the still solid glue stick acts as a piston to push the melted glue out the nozzle and onto the work piece. In early forms of glue guns, the glue stick was advanced directly by the user, such as by pressing directly on the back end of the glue stick with the user's thumb.

Pressing directly on the glue stick has problems, however, since the glue stick has a tendency to become hot during operation of the device. Furthermore, on occasion, due to either failure by the user to allow sufficient time for the heating chamber to warm up, or the user applying the glue at a rate too high to allow adequate melting of the glue stick in the heating chamber, the glue may be inadequately melted in the heating chamber. If the glue is inadequately melted, and the user continues to attempt to force glue through the heating chamber when it is still in a solid or semi-solid state, excessive force may be imparted to the parts of the mechanism and to the heating chamber, causing damage.

Various types of advancing mechanisms which advance the glue stick into the heating chamber without the need for the user to directly press on the glue stick, and which prevent excessive force, have been proposed. Prior art glue stick advancing mechanisms include those having a slidable carriage member holding the glue stick with an angularly rotatable gripping member pivoted about a hinge pin attached to the carriage member, such as described in U.S. Pat. No. 4,523,705, issued June 18, 1985. As described therein, the gripper member is connected to a tension spring which is, in turn, connected via a cable and pulley arrangement to a sliding trigger. Squeezing the trigger pulls the cable around the pulley which, in turn, pulls on the tension spring which then pulls on the gripper member to cause angular rotation of the gripper member about the hinge pin. This forces a corner of the gripper member against the glue stick, thereby clamping the glue stick in the carriage member. Continued application of force to the gripper member causes the carriage to slide longitudinally forward with the glue stick to advance the glue stick into the heating chamber. If excessive forces are applied, the spring expands, limiting the force which can be applied to the gripper member.

While these prior art glue guns are satisfactory in many applications, the present design of the glue advancing mechanism has difficulties. Attachment of the gripper to the slidable carriage with a hinge pin increases the cost of the mechanism if a metallic hinge pin is used for strength. If the hinge pin is molded of plastic to decrease cost, the strength of the hinge pin may not be adequate. Use of a cable and pulley arrangement for attachment to the tension spring, although satisfactory from the standpoint of preventing excessive force, is mechanically complicated and hence expensive.

OBJECTS OF THE INVENTION

Accordingly, it is an object of the present invention to provide a mechanism for advancing the glue stick in a glue gun which is simple and inexpensive to manufacture, and yet is robust and not prone to breakage.

It is a further object of the present invention to provide a mechanism for advancing the glue stick in a glue gun which has a simple pivoted hand lever connected directly to a lever end of a gripper member by means of a tension spring, with no other intermediate cables, linkages, or other parts.

SUMMARY OF THE INVENTION

The foregoing and other objects are achieved in a device for heating a substantially solid heat softenable glue stick until said glue is substantially melted and ejecting the melted glue from the device. This device has a housing and a heating chamber mounting in the housing. The heating chamber has an opening therethrough, one end of the opening defining an entrance for the substantially solid glue stick and another end defining an exit for the melted glue to be ejected. Means for advancing the substantially solid heat glue stick into the entrance of the opening in the heating chamber to melt the glue and to eject the melted glue from the device are provided which includes a longitudinally slidable carriage member with a longitudinal opening for the glue stick. The carriage member has a transverse opening in communication with its longitudinal opening, and this transverse opening has internal peripheral bearing surfaces. An angularly displaceable gripper member which has a transverse lever and a gripper head is included. The transverse lever has an end which extends through the transverse opening, and the gripper head is receivable into the transverse opening. The gripper head has a front end, a rear end, an upper end and a gripper tooth near its front and upper ends for gripping the glue stick. The gripper head further has exterior peripheral bearing surfaces near its front and rear ends which slidably bear against the internal peripheral bearing surfaces of the transverse opening to retain the gripper head in the transverse opening while permitting angular displacement of the head so that a force applied to the end of the transverse lever will cause angular displacement of the gripper head to cause the gripper tooth to grip the glue stick.

In another embodiment of the present invention, a device for heating a substantially solid heat softenable glue stick until the glue is substantially melted and ejecting the melted glue from the device is provided. This device has a housing and a heating chamber mounting in the housing. The heating chamber has an opening therethrough, one end of the opening defining an entrance for the substantially solid glue stick and another end defining an exit for the melted glue to be ejected. Means for advancing the substantially solid heat glue stick into the entrance of the opening in the heating chamber to melt the glue and to eject the melted glue from the device are provided which include a longitudinally slidable carriage member having a longitudinal opening for the glue stick. The carriage member has a first transverse opening in communication with the longitudinal opening and a second transverse opening in communication with the first transverse opening and also transverse to the first transverse opening. The first transverse opening has internal peripheral bearing surfaces. A substantially T-shaped angularly displaceable gripper member is included which has an upper member defining a gripper head and a lower member defining a transverse lever. The transverse lever has an end which extends through the second transverse opening. The gripper head is receivable into the first transverse opening and has a front end, a rear end, and upper end and a gripper tooth near its front and upper ends for gripping the glue stick. The gripper head further has exterior peripheral bearing surfaces near its front and rear ends which slidably bear against the internal peripheral bearing surfaces of the first transverse opening to retain the gripper head in the first transverse opening while permitting angular displacement of the head. Thus, a force applied to the end of the transverse lever will cause angular displacement of the gripper head, causing the gripper tooth to grip the glue stick.

In another embodiment of the present invention, the first transverse opening of the carriage member extends fully through one side of the carriage member so that that gripper head can be received into the first transverse opening from the side of the carriage member.

In still another embodiment of the present invention, a device for heating a substantially solid heat softenable glue stick until the glue is substantially melted and ejecting the melted glue from the device is provided. This device has a housing and a heating chamber mounting in the housing. The heating chamber has an opening therethrough, one end of the opening defining an entrance for the substantially solid glue stick and another end defining an exit for the melted glue to be ejected. Means for advancing the substantially solid glue stick into the entrance of the opening in the heating chamber to melt the glue and to eject the melted glue from the device are provided which include means consisting essentially of a manually operable pivoted hand lever, a lonitudinally slidable carriage member, an angularly displaceable gripper member retained in the carriage member and a tension spring. The hand lever has a finger receiving end, a spring attachment end and a pivot between these ends. The tension spring has two ends, one of which is attached to the spring attachment end of the trigger and the other of which is attached directly to the gripper member to transmit force to the gripper member to cause angular rotation of the gripper member.

The foregoing and other objects, features and advantages of the present invention will become apparent from the following detailed description of illustrative embodiments thereof, which is to be read in conjunction with the accompanying drawings, wherein:

DETAILED DESCRIPTION

Figures 1, 2:
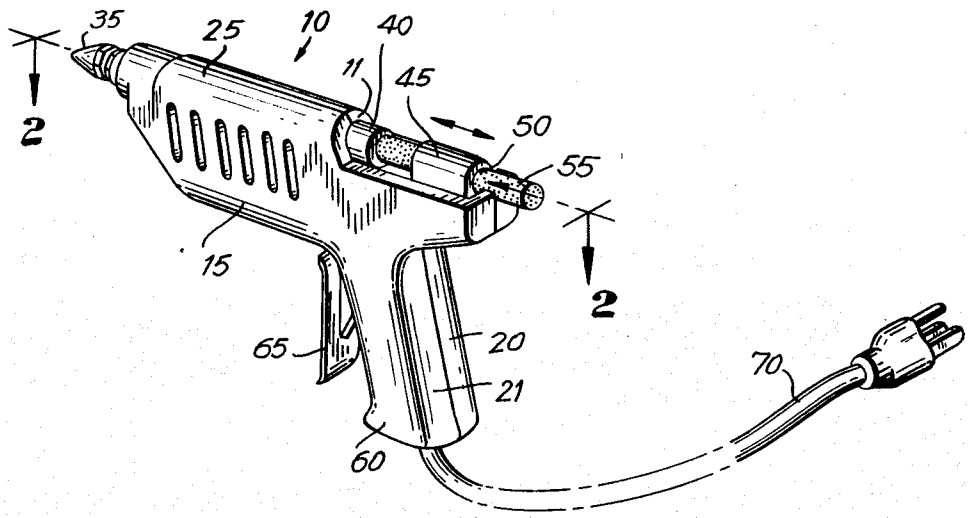
FIG. 1 is a perspective external view of a glue gun utilizing an embodiment of the present invention and showing an externally visible portion of the slidable carriage.
FIG. 2 is a cross-sectional view taken along the line 2—2.

Referring now to the drawings in detail, and initially to FIGS. 1 and 2, a glue gun 10 constructed in accordance with an embodiment of the present invention is depicted. The glue gun 10 has a housing 15 constructed of two medially split sides 20 and 21, preferably molded of plastic. The housing 15 has a front portion 25 which houses a heating chamber 30 (concealed in FIG. 1 but visible in FIG. 2). At the front end of the gun is a nozzle 35 connected to the heating chamber 30 through which the glue which is melted in the heating chamber 30 discharges or is ejected onto the work piece. The heating chamber 30 has a longitudinal opening 33 therethrough, the rear end of which defines an entrance 31 for the substantially solid glue stick, and the front end of which defines an exit 32 through which the melted glue is ejected. A tubular seal 40, preferably of rubberlike material, is attached to the entrance 31 of the heating chamber 30 to minimize leakage of melted glue.

A longitudinally slidable carriage member 45 is slidably mounted in the housing 15, behind the seal 40. This carriage 45 has a longitudinal opening 50 extending through it, through which the glue stick 55 passes. The upper rear portion 11 of the gun 10 is preferably open so that the user can readily discern if glue is leaking past the seal 40 at the entrance to the heating chamber 30, and so that movement of the slidable carriage 45 can be observed.

For convenient manual operation, the glue gun 10 is equipped with a hand grip 60 and an operating hand lever 65. Squeezing the hand grip end 65 of operating lever 145 causes the slidable carriage 45 to advance in a manner which is depicted in FIGS. 3–6, to be hereinafter described, thereby advancing the glue stick into the heating chamber 30. An electric cord 70 is provided for delivering electric current to the heating chamber 30.

Figure 3:
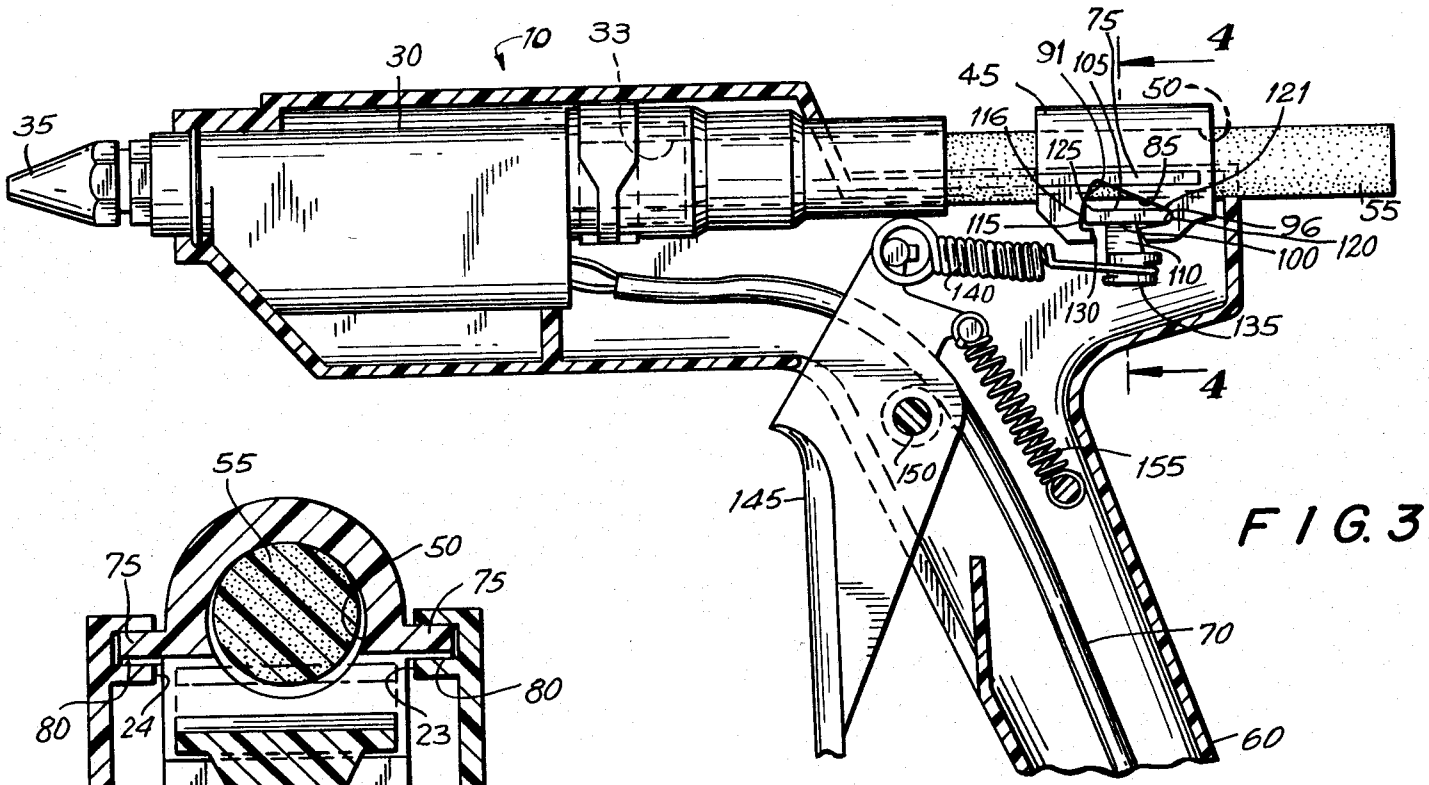
FIG. 3 is a cross-sectional view taken along the line 3—3 of FIG. 2.
Figure 4:
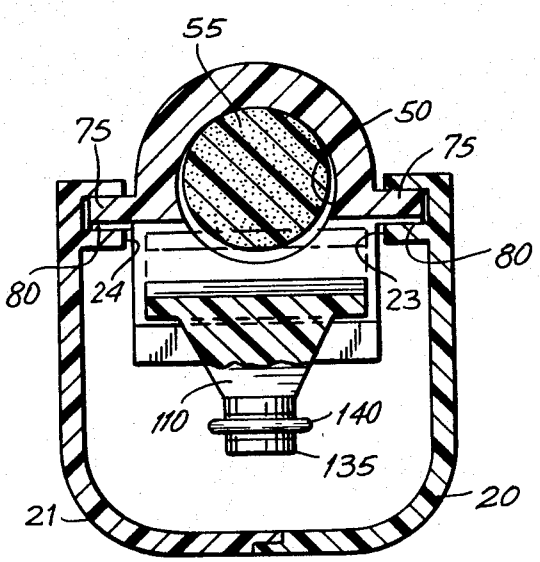
FIG. 4 is a cross-sectional view taken along the line 4—4.

Referring now to FIGS. 3 and 4, the mechanism for advancing the glue stick will be described in detail. The carriage member 45 is preferably molded of a single piece of a suitable material, such as plastic resistant to the temperatures employed. The glue stick 55 extends through the longitudinal hole 50 in the carriage 45, through the seal 40, and hence into the entrance 31 of the longitudinal opening 30 of the heating chamber 30. The hole 50 is preferably sized somewhat larger than the outside diameter of the glue stick to avoid jamming and to allow easy insertion. The carriage 45 is preferably provided with longitudinal rails 75 on each side which fit into corresponding slots 80 on the housing 15. The carriage 45 has a transverse opening 85 in communication with the longitudinal opening 50, which transverse opening preferably extends fully through at least one side of the carriage to allow easy assembly. In the preferred form of the invention disclosed in the figures, the transverse opening 85 is preferably wedge-shaped, with its narrow end 95 towards the rear of the carriage and its wide front end 90 near the front of the carriage. The internal surfaces of the wide front end 90 and the narrow rear end 95 of the opening 85 defined slidable internal peripheral bearing surfaces 91 and 96, respectively for the gripper member 100, to be described in more detail below.

The gripper member 100, which is preferably substantially T-shaped and preferably is molded of plastic material, is received into the transverse opening 85. The gripper member 100 has a head portion 105 and a lower portion defining a transverse lever 100. The head 105 has a front end 115 and a rear end 120. Front and rear ends 115 and 120 define peripheral slidable bearing surfaces 116 and 121, respectively, which slide against the internal peripheral bearing surfaces 91 and 96 of the slot 85. A wedge-shaped gripper tooth 125 having an acute angle is included on the gripper head 105 near its front upper portion, for gripping the glue stick.

The use of the carriage 45 with internal peripheral bearing surfaces 91 and 96 bearing against the peripheral front and rear bearing surfaces 116 and 121 of the gripper head is believed to have considerable advantages over the hinge pin pivoted gripper members of the prior art. The gripper member of the present invention requires no separate hinge pin, and is thus easy to manufacture. Furthermore, because the major stresses are applied to a relatively long surface of the rear bearing surface 96 on the gripper head, decreased unit bearing stresses result as compared to the concentrated stresses which are present when a hinge pin type gripper member is used.

The gripper head 105 is preferably slightly smaller than the opening 85, and thus is freely insertable from the side of the carriage member 45 to simply assembly. Furthermore, the slot or opening 85 preferably extends through at least one side of the carriage. This allows the gripper 100 to be easily inserted directly from one side of the carriage without disassembly of the carriage, thereby simplifying assembly of the glue gun. The sides of the housing 20 and 21 have internal faces 23 and 24 in close proximity to the carriage and thus keep the gripper from falling sideways out of the opening 50 during operation of the device.

The carriage 45 preferably has a second transverse, preferably downwardly open, slot 130 in communication with the first transverse slot 85, through which the transverse lever 110 extends. The transverse lever 110 has a free end 135 to which is connected an end of a tension spring 140. The other end of tension spring 140 is connected directly to an actuating lever 145 which is pivoted by means of a hinge pin 150 in the housing. A return spring 155 attached to the actuating hand lever 145 and the housing is included for applying a counterforce to the actuating lever 145.

Figure 5:
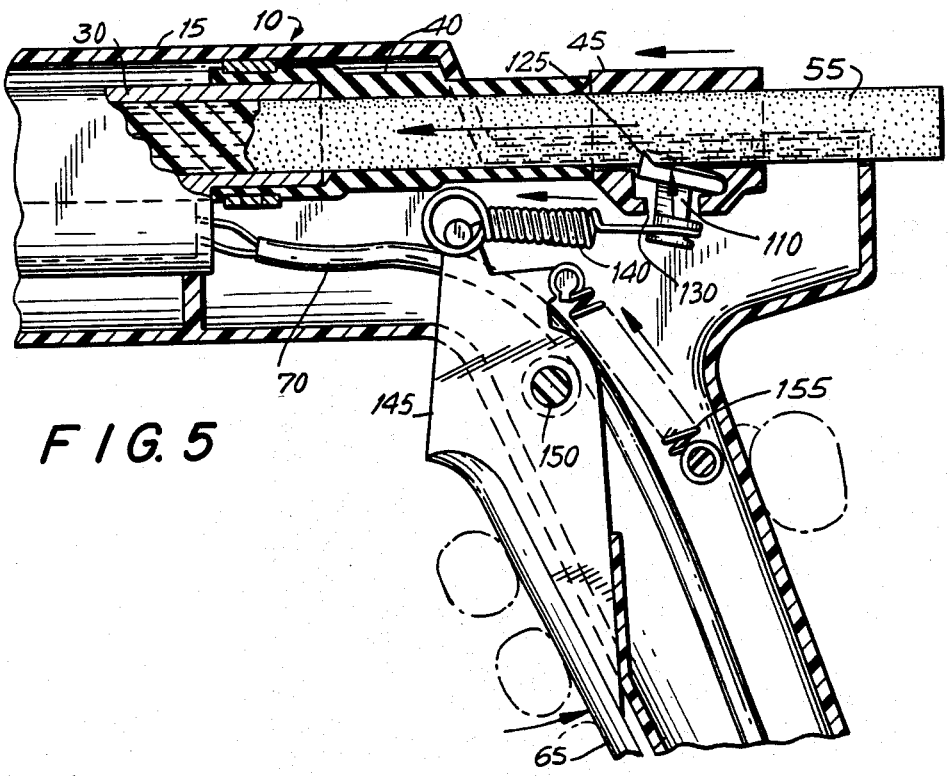
FIG. 5 is a cross-sectional view taken along the line 3—3 showing the slidable carriage assembly in an advanced condition with the gripper tooth of the gripper member gripping the glue stick when an excessive force is not being applied to the hand lever.
Figure 6:
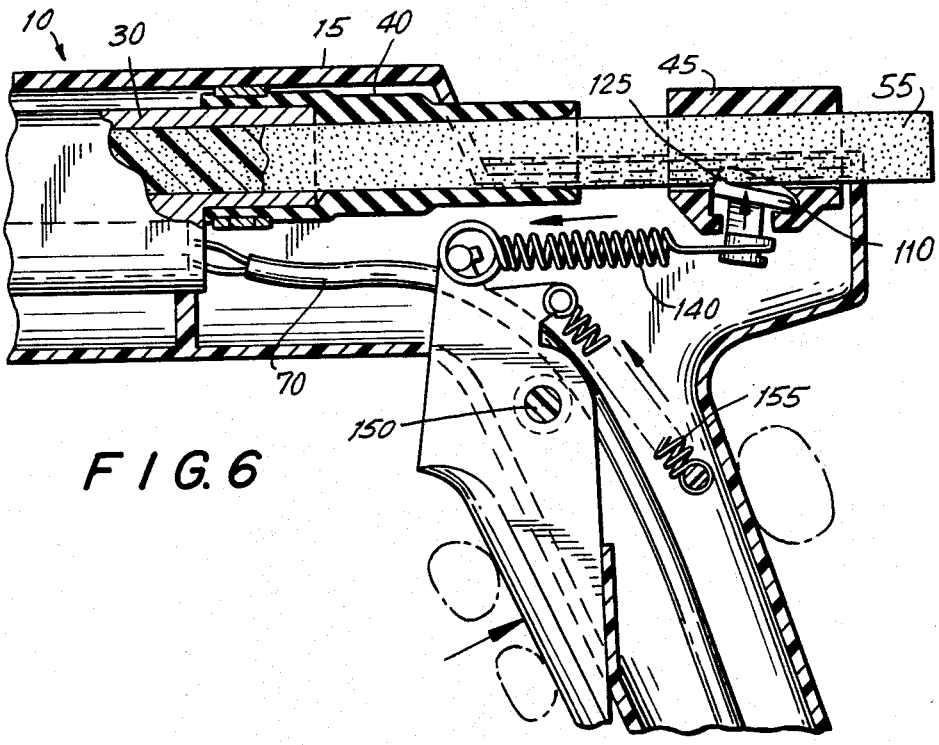
FIG. 6 is a cross-sectional view taken along the line 3—3 showing the slidable carriage assembly in an advanced condition with the gripper tooth gripping the glue stick when excessive force is being applied to the hand lever.

Referring now to FIGS. 5 and 6, a sequence of operation of the advancing mechanism of the present invention will now be described. FIGS. 5 and 6 depict the glue gun with the gripper member 100 angularly displaced so that the gripper tooth 125 is engaged into the glue stick with the carriage 45 in the advanced condition, as it would be following depressing of the actuating lever 145. The actuating lever 145 has been depressed by the user's fingers to its maximum extent. In FIG. 5, the heating conditions in the heating chamber 30 are adequate for complete melting of the glue stick, and no excessive force has been applied, so the preloaded tension spring 140 is not been extended beyond its initial preload.

An operating condition where insufficinet melting of the glue stick has occurred in the heating chamber is depicted in FIG. 6. In this figure, actuating lever 145 has been fully depressed, but insufficient melting is preventing the glue stick from fully entering the heating chamber 30. The movement of the spring 140 forward causes angular displacement of gripper member 110 so that the gripper tooth 125 engages the glue stick. But because the glue stick is prevented from further advancement by the insufficient melting, further movement of the actuating lever extends the tension spring 140, thus preventing excessive forces from being applied to the glue stick or the parts of the glue gun.

It is thus seen that the present invention provides an advancing mechanism for a glue gun which is robust yet easy and inexpensive to manufacture and assemble.

The terms and expressions which have been employed herein are used as terms of description and not of limitation, and there is no intention in the use of such terms or expressios of excluding any equivalents of the features shown and described and portions thereof. In particular, the term "glue" has been used for convenience to refer to heat softenable substances, but this term is intended to also include materials intended for sealing or other uses other than adhesives. Similarly, the term "glue stick" has been used to refer to the solidified rod-shaped heat softenable material which is used in the glue gun, but is not intended to be limited to only adhesives. Although illustrative embodiments of the invention have been described herein with reference to the accompanying drawings, it is to be understood that various changes and modifications can be effected therein without departing from the scope or spirit of the invention.

What is claimed is:

1. A device for heating a substantially solid heat softenable glue stick until said glue is substantially melted and ejecting said melted glue from said device, said device comprising:

(a) a housing;

(b) a heating chamber mounted in said housing, said heating chamber having an opening therethrough, an end of said opening defining an entrance for said substantially solid glue stick and another end defining an exit for said melted glue;

(c) means for advancing said substantially solid glue stick into the entrance of said opening in said heating chamber to melt said glue and to eject said melted glue from said device, said means comprising a longitudinally slidable carriage member having a longitudinal opening for said glue stick and a transverse opening in communication with said longitudinal opening, said transverse opening having internal peripheral bearing surfaces, an angularly displaceable gripper member having a transverse lever and an gripper head, said transverse lever having an end extending through said transverse opening, said gripper head being receivable into said transverse opening and having a front end, a rear end, an upper end and a gripper tooth near said gripper head front and upper end for gripping said glue stick, said gripper head further having exterior peripheral surfaces substantially defined by its front and rear ends which slidably bear against said internal peripheral bearing surfaces of said transverse opening to retain said gripper head in said transverse opening while permitting angular displacement of said head so that a force applied to said end of said transverse lever will cause angular displacement of said gripper head causing said gripper tooth to grip said glue stick.

2. A device for heating a substantially solid heat softenable glue stick until said glue is substantially melted and ejecting said melted glue from said device, said device comprising:

(a) a housing;

(b) a heating chamber mounting in said housing, said heating chamber having an opening therethrough, an end of said opening defining an entrance for said substantially solid glue stick and another end defining an exit for said melted glue;

(c) means for advancing said substantially solid heat glue stick into the entrance of said opening in said heating chamber to melt said glue and to eject said melted glue from said device, said means comprising a longitudinally slidable carriage member having a longitudinal opening for said glue stick, a first transverse opening in communication with said longitudinal opening and a second transverse opening in communication with said first transverse opening and transverse to said first transverse opening, said first transverse opening having internal peripheral bearing surfaces, a substantially T-shaped angularly displaceable gripper member having an upper member defining a gripper head and a lower member defining a transverse lever, said transverse lever having an end extending through said second transverse opening, said gripper head being receivable into said first transverse opening and having a front end, a rear end, an upper end and a gripper tooth near said gripper head front and upper end for gripping said glue stick, said gripper head further having exterior peripheral surfaces substantially defined by its front and rear ends which slidably bear against said internal peripheral bearing surfaces of said first transverse opening to retain said gripper head in said first transverse opening while permitting angular displacement of said head so that a force applied to said end of said transverse lever will cause angular displacement of said gripper head causing said gripper tooth to grip said glue stick.

3. The device as defined in claim 2, wherein said gripper head is slightly smaller than said first transverse opening in said carriage member and wherein said transverse opening extends fully through at least one side of said carriage member and wherein said second transverse opening in communication with said first transverse opening is fully open through said one side of said carriage member so that said gripper head including its transverse lever can be freely inserted sidewise through the side of the carriage member into its operating position in said carriage member.

4. A device for heating a substantially solid heat softenable glue stick until said glue is substantially melted and ejecting said melted glue from said device, said device comprising:

(a) a housing;

(b) a heating chamber mounted in said housing, said heating chamber having an opening therethrough, an end of said opening defining an entrance for said substantially solid glue stick and another end defining an exit for said melted glue;

(c) means for advancing said substantially solid glue stick into the entrance of said opening in said heating chamber to melt said glue and to eject said melted glue from said device, said means comprising a longitudinally slidable carriage member having a longitudinal opening for said glue stick, a first transverse opening in communication with said longitudinal opening and extending fully through one side of said carriage member, a second transverse opening in communication with said first transverse opening and transverse to said first transverse opening, said first transverse opening having internal peripheral bearing surfaces, a substantially T-shaped angularly displaceable gripper member having an upper member defining a gripper head and a lower member defining a transverse lever, said transerse lever having an end extending through said second transverse opening, said gripper head being receivable into said first transverse opening and having a front end, a rear end, an upper end and a gripper tooth near said gripper head front and upper end for gripping said glue stick, said front and rear ends of said gripper head further having exterior peripheral surfaces substantially defined by its front and rear ends which slidably bear against said internal peripheral bearing surfaces of said first transverse opening to retain said gripper head in said first transverse opening while permitting angular displacement of said head so that a force applied to said end of said transverse lever will cause angular displacement of said gripper head causing said gripper tooth to grip said glue stick.

5. A device for heating a substantially solid heat softenable glue stick until said glue is substantially melted and ejecting said melted glue from said device, said device comprising:

(a) a housing;

(b) a heating chamber mounted in said housing, said heating chamber having an opening therethrough, an end of said opening defining an entrance for said substantially solid glue stick and another end defining an exit for said melted glue;

(c) means for advancing said substantially solid glue stick into the entrance of said opening in said heating chamber to melt said glue and to eject said melted glue from said device, said means comprising a longitudinally slidable carriage member having a longitudinal opening for said glue stick and a transverse opening in communication with said longitudinal opening, said transverse opening having internal peripheral bearing surfaces, an angularly displaceable gripper member having a transverse lever and an gripper head, said transverse lever having an end extending through said transverse opening, said gripper head being receivable into said transverse opening and having a front end, a rear end, an upper end and a gripper tooth near said gripper head front and upper end for gripping said glue stick, said gripper head further having exterior peripheral surfaces near its front and rear ends which slidably bear against said internal peripheral bearing surfaces of said transverse opening to retain said gripper head in said transverse opening while permitting angular displacement of said head so that a force applied to said end of said transverse lever will cause angular displacement of said gripper head causing said gripper tooth to grip said glue stick; and a manually operable trigger, said trigger having a finger receiving end and a spring attachment end, said trigger being pivoted about a point on said trigger between said finger receiving end and said spring attachment end; a tension spring having two ends, one of said ends being attached to said spring attachment end of said trigger and the other of said ends being attached directly to said gripper member to apply a force to said gripper member to cause angular rotation of said gripper member, said spring being extensible to prevent excessive force from being applied to the glue stick.

6. The device as defined in claim 5, wherein said tension spring has an initial tension preload which must be overcome prior to extension of said spring.

7. A device for heating a substantially solid heat softenable glue stick until said glue is substantially melted and ejecting said melted glue from said device, said device comprising:

(a) a housing;

(b) a heating chamber mounted in said housing, said heating chamber having an opening therethrough, an end of said opening defining an entrance for said substantially solid glue stick and another end defining an exit for said melted glue;

(c) means for advancing said substantially solid heat glue stick into the entrance of said opening in said heating chamber to melt said glue and to eject said melted glue from said device, said means comprising (i) a longitudinally slidable carriage member having a longitudinal opening for said glue stick and a transverse opening in communication with said longitudinal opening, said transverse opening having internal peripheral bearing surfaces, (ii) a gripper member disposed in said carriage member, said gripper member having a front end and a rear end, said front end having means for gripping said glue stick, said gripper member further including external peripheral bearing surfaces substantially defined by its front and rear ends for slidably bearing against said internal peripheral bearing surfaces, said gripper member having a first position with respect to said carriage member wherein said gripping means grips said rod and a second position wherein said gripper member does not grip said rod.

8. A device for heating a substantially solid heat softenable glue stick until said glue is substantially melted and ejecting said melted glue from said device, said device comprising:

(a) a housing;

(b) a heating chamber mounted in said housing, said heating chamber having an opening therethrough, an end of said opening defining an entrance for said substantially solid glue stick and another end defining an exit for said melted glue;

(c) means for advancing said substantially solid glue stick into the entrance of said opening in said heating chamber to melt said glue and to eject said melted glue from said device, said means comprising a longitudinally slidable carriage member having a longitudinal opening for said glue stick and a transverse opening in communication with said longitudinal opening, said transverse opening having internal peripheral bearing surfaces, an angularly displaceable gripper member having a transverse lever and an gripper head, said transverse lever having an end extending through said transverse opening, said gripper head being receivable into said transverse opening and having a front end, a rear end, an upper end and a gripper corner near said gripper head front and upper end for gripping said glue stick, said gripper head further having exterior peripheral surfaces substantially defined by its front and rear ends which slidably bear against said internal peripheral bearing surfaces of said transverse opening to retain said gripper head in said transverse opening while permitting angular displacement of said head so that a force applied to said end of said transverse lever will cause angular displacement of said gripper head causing said gripper corner to grip said glue stick.

* * * * *